US006652311B2

(12) United States Patent
LePottier et al.

(10) Patent No.: US 6,652,311 B2
(45) Date of Patent: Nov. 25, 2003

(54) POLARIZED CONNECTOR FOR FLAT FLEXIBLE CIRCUITRY

(75) Inventors: Yves LePottier, Grosse Pointe, MI (US); Robert M. Fuerst, West Bloomfield, MI (US); David A. Pfaffinger, Holly, MI (US); Jonathan D. Lohman, West Chicago, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/960,170

(22) Filed: Sep. 21, 2001

(65) Prior Publication Data

US 2003/0060079 A1 Mar. 27, 2003

(51) Int. Cl.[7] ..... H01R 12/24
(52) U.S. Cl. ..... 439/492; 174/267
(58) Field of Search ..... 439/492, 677, 439/680, 678, 495; 174/250, 255, 267

(56) References Cited

U.S. PATENT DOCUMENTS

| | | | | | |
|---|---|---|---|---|---|
| 3,999,826 | A | * | 12/1976 | Yurtin | 439/495 |
| 4,725,243 | A | * | 2/1988 | Pretchel et al. | 439/395 |
| 5,924,891 | A | * | 7/1999 | Benjamin et al. | 439/495 |
| 6,356,449 | B1 | * | 3/2002 | Sasaki et al. | 361/749 |

* cited by examiner

*Primary Examiner*—Renee Luebke
*Assistant Examiner*—Ann McCamey
(74) *Attorney, Agent, or Firm*—Stacey E. Caldwell

(57) ABSTRACT

A polarizing system is provided in a connector for electrically interconnecting the conductors of a flat flexible circuit to the conductors of a complementary connecting device. The flat flexible circuit has a longitudinal center-line and a pattern of polarizing holes therein asymmetrical to the center-line. A connector body member positions the flat flexible circuit thereon and has an asymmetrical pattern of polarizing posts insertable into the polarizing holes of the flat flexible circuit.

8 Claims, 2 Drawing Sheets

POLARIZED CONNECTOR FOR FLAT FLEXIBLE CIRCUITRY

FIELD OF THE INVENTION

This invention generally relates to the art of electrical connectors and, particularly, to connectors for electrically interconnecting flat flexible circuitry.

BACKGROUND OF THE INVENTION

A flat flexible circuit conventionally includes an elongated flat flexible dielectric substrate having laterally spaced strips of conductors on one or both sides thereof. The conductors may be covered with a thin, flexible protective layer on one or both sides of the circuit. If protective layers are used, openings are formed therein to expose the underlying conductors at desired contact locations where the conductors are to engage the conductors of a complementary mating connecting device which may be a second flat flexible circuit, a printed circuit board or the discrete terminals of a mating connector.

A wide variety of connectors have been designed over the years for terminating or interconnecting flat flexible circuits with complementary mating connecting devices. However, problems continue to be encountered with such connectors. For instance, considerable problems can be created if a flat flexible circuit is positioned upside down in or on the connector. In other words, typically the circuit is positioned on the connector with the conductors of the circuit facing away from some form of carrier so that the conductors face the intended mating electrical interface. If the circuit is positioned on the carrier upside down, the conductors would face away from the intended mating electrical interface which would result in an unexpected open circuit condition at the interface. The present invention is directed to solving these problems in a polarizing system which would have very little impact on costs, lead times and tooling of the connector.

SUMMARY OF THE INVENTION

An object, therefore, of the invention is to provide a new and improved connector for electrically interconnecting the conductors of a flat flexible circuit to the conductors of a complementary connecting device, the connector including a polarizing system to prevent the circuit from being improperly oriented in the connector.

In the exemplary embodiment of the invention, the flat flexible circuit has a longitudinal center-line and a pattern of polarizing holes. The pattern is asymmetrical to the center-line of the circuit. The connector includes a body member for positioning the flat flexible circuit thereon. The body member has a pattern of polarizing posts insertable into the polarizing holes of the flat flexible circuit.

As disclosed herein, the connector body member comprises a generally elongated male body member having a leading edge at which the flexible circuit is positioned. The polarizing posts are located adjacent the edge. The polarizing holes in the flat flexible circuit are located adjacent a leading edge of the circuit. In the preferred embodiment, the circuit includes at least one polarizing hole on each opposite side of the center-line thereof, the holes being spaced different distances from the center-line. Therefore, the circuit cannot be mounted upside down on the connector body member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
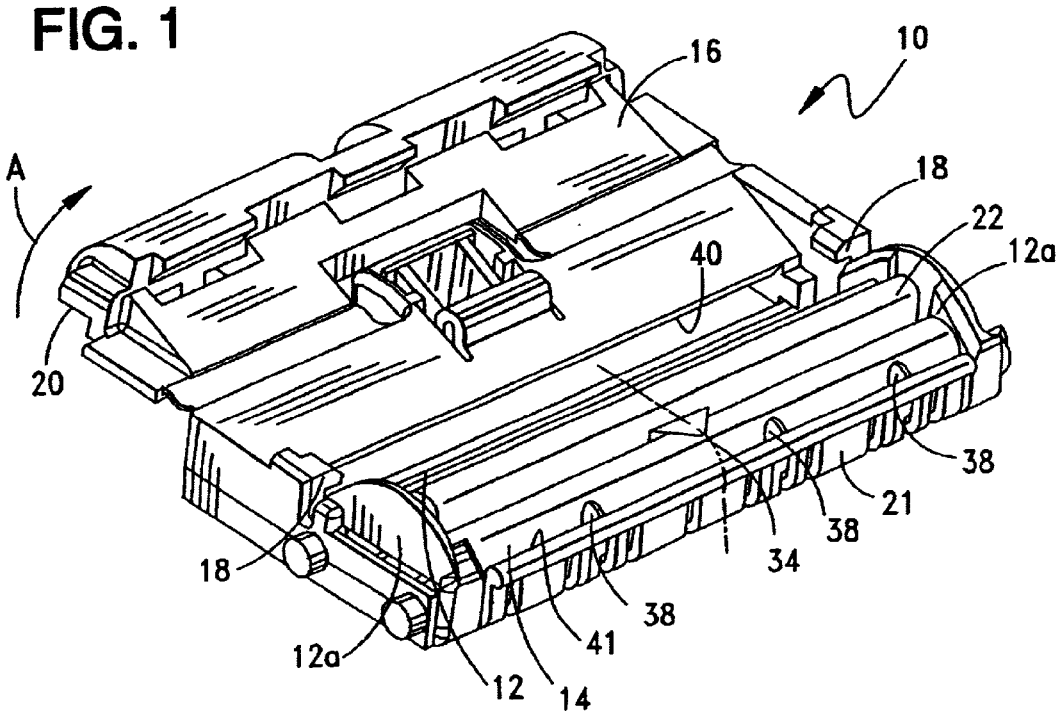
FIG. 1 is a front perspective view of a connector embodying the concepts of the invention, in open condition.

Referring to the drawings in greater detail, and first to FIG. 1, the invention is embodied in an electrical connector, generally designated 10, which includes a base in the form of an elongated male body member 12 having a leading edge 14 at which a flat flexible circuit is positioned, as described hereinafter. A pair of side guide walls 12*a* are formed at opposite sides of the male body member immediately behind leading edge 14. A cover 16 is hinged to the body member for pivotal movement in the direction of arrow "A" from an open position shown in FIG. 1 to a closed position shown in FIG. 4. A pair of latch arms 18 are formed at opposite sides of the body member for engaging a pair of latch shoulders 20 at opposite sides of the cover to hold the cover in closed position securing the flat flexible circuit within the connector. A lip 21 runs the length of leading edge 14 of the body member spaced forwardly thereof. An elevated rib 22 runs the length of the body member behind leading edge 14 to provide a yieldable backing for the flexible circuit.

Figure 2:
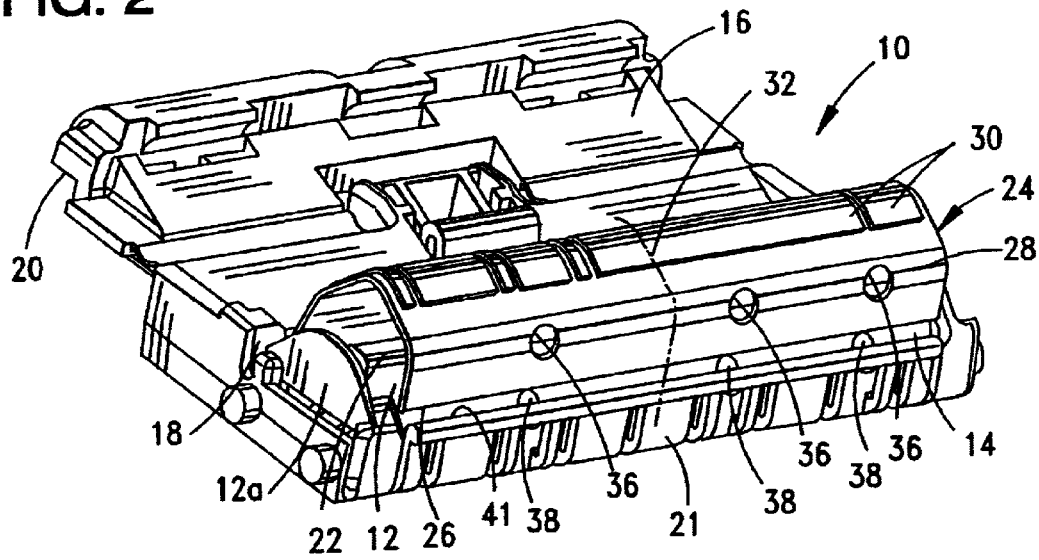
FIG. 2 is a view similar to that of FIG. 1, with the flat flexible circuit being assembled to the connector.

FIG. 2 shows a flat flexible circuit, generally designated 24, in the process of being assembled to connector 10. The circuit is elongated and includes a leading edge 26. The circuit is typical in that it includes an elongated flat flexible dielectric substrate 28 having laterally spaced strips of conductors 30 on one side thereof facing away from male body member 12 for interconnection to the conductors of a complementary mating connecting device (not shown). For purposes of the invention, flat flexible circuit 24 has a center-line 32 which corresponds to a center-line 34 (FIG. 1) of elongated body member 12 of connector 10.

The invention contemplates a polarizing system to prevent flat flexible circuit 24 from being assembled in connector 10 upside down wherein conductors 30 would not be exposed on top of the circuit as shown in FIG. 2. In other words, as stated in the "Background", above, if the circuit were assembled in the connector upside down, an unexpected open circuit condition would be created at the interface of connector 10 with the complementary connecting device. It can be seen in FIG. 2 that conductors 30 are intended to face outwardly from flat flexible circuit 24 for engaging the conductors of the complementary connecting device. If the circuit were assembled upside down, the conductors would face inwardly toward backing rib 22, and there would be no conductive interface with the complementary mating connecting device.

The polarizing system of the invention includes a pattern of polarizing holes 36 formed through substrate 28 of flat flexible circuit 24 near edge 26 thereof. This pattern of holes is asymmetrical to center-line 32 of the circuit. In other words, the number and/or spacing of the holes on opposite sides of center-line 32 are different. Although multiple holes on opposite sides of the center-line are preferred to provide a balanced assembly of the circuit to the connector body member, the polarizing system of the invention contemplates a single hole on only one side of the center-line. The single hole would have a given spacing to one side of the center-line, and the circuit would be void of a hole at the same spacing on the opposite side of the center-line.

With the asymmetrical pattern of polarizing holes 36 in flat flexible circuit 24, elongated male body member 12 includes a complementary asymmetrical pattern of polarizing posts or projections 38 near leading edge 14 (FIG. 1) of the body member. In other words, the number and spacing of polarizing posts 38 relative to center-line 34 in FIG. 1 is the same as the number and spacing of holes 36 relative to center-line 32 of the circuit in FIG. 2.

Figure 3:
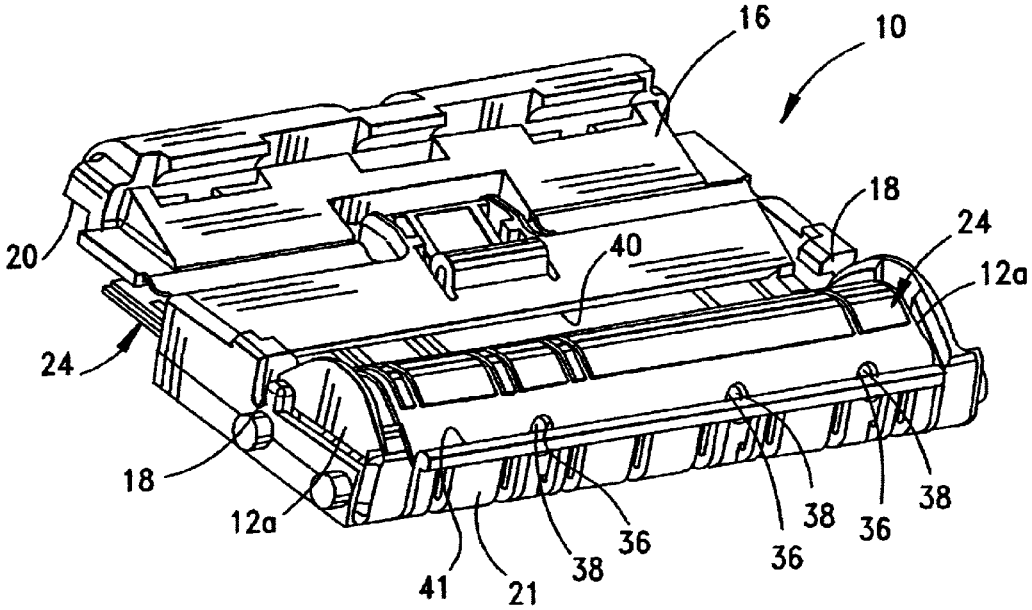
FIG. 3 is a view similar to that of FIGS. 1 and 2, with the circuit fully assembled on the connector.

FIG. 3 shows flat flexible circuit 24 fully assembled to male body member 12 of connector 10 between side guide walls 12*a*, with the circuit extending rearwardly through a passage 40 in the body member. Leading edge 26 (FIG. 2) of the circuit is inserted into a slot 41 behind lip 21. It can be seen that polarizing posts 38 of the body member are secured within polarizing holes 36 in the flat flexible circuit. It can be understood that the circuit now is secured to the body member. If the circuit was assembled upside down, polarizing holes 36 in the circuit would not match up positionally with polarizing posts 38 of the body member, and the circuit could not be secured in the connector.

Figure 4:
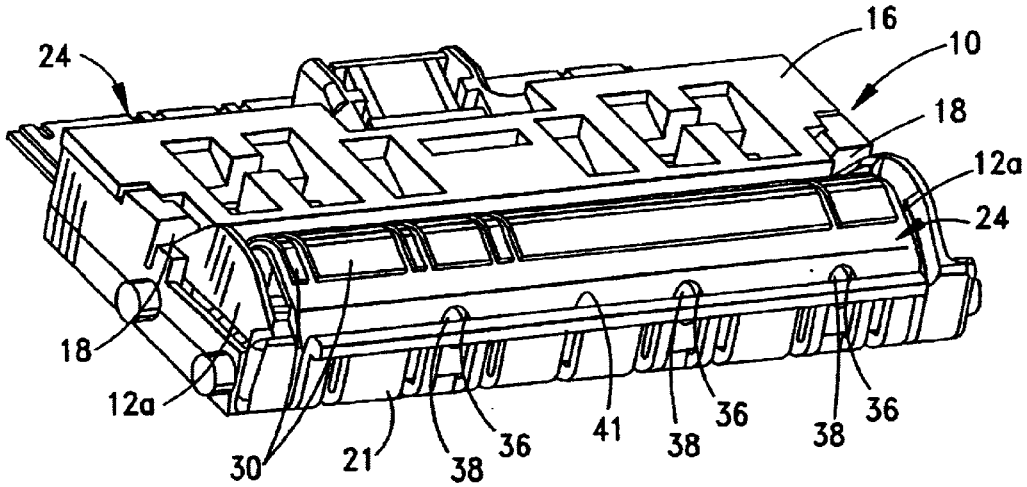
FIG. 4 is a view similar to that of FIG. 3, with the cover in closed condition.

FIG. 4 simply shows the connector with cover 16 pivoted and closed down onto body member 12 and held in closed position by latch arms 18. Flat flexible circuit 24 now is held rigidly in the connector, with conductors 30 facing away therefrom for interconnection to the conductors of the complementary mating connecting device.

It should be understood that polarizing holes 36 in flat flexible circuit 24 and polarizing posts 38 on body member 12 of connector 10 provide a simply and effective polarizing system to ensure that the flat flexible circuit is not assembled upside down in the connector. However, this polarizing system also provides a means for keying any given circuit to any given connector. In other words, different patterns of conductors 30 are provided on different flexible substrates to provide different circuit geometries. A plurality of connectors could be coded for receiving specific circuits with specific geometries, and the asymmetrical patterns of holes 36 and posts 38 can be varied practically infinitely to match a given circuit with a given connector. This total customization of the connector assembly can be achieved very easily and with low cost. The holes in the circuit substrate can be made by optical tooling that has very little associated costs. The posts similarly can be changed with low cost tooling, as needed. These changes, along with the ability to change the conductor routing on the circuit, can result in a multiple of custom connectors with very little impact on cost, lead times and tooling.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A polarizing system in a connector for electrically interconnecting conductors of a flat flexible circuit to conductors of a complementary connecting device, comprising:

a flat flexible circuit having opposite flat sides and generally parallel opposite edges all leading to a transverse leading edge of the circuit insertable into the connector in a circuit-insertion direction, with a longitudinal center-line generally parallel to said circuit-insertion direction and generally equidistant from the opposite edges of the circuit, a pattern of polarizing holes in the circuit asymmetrical to said center-line, the holes being spaced rearwardly from the leading edge of the circuit, and a plurality of generally parallel conductors on the circuit with distal ends of the conductors being spaced rearwardly from said pattern of polarizing holes; and a connector body member having a pair of side guide walls for positioning the flat flexible circuit therebetween in said circuit-insertion direction and exposing the conductors of the circuit for engagement with the conductors of the complementary connecting device, the body member defining a center-line between the side guide walls coincident with the longitudinal center-line of the flat flexible circuit, the body member having a pattern of polarizing posts insertable into the polarizing holes insertable into the polarizing holes in the circuit, the pattern of polarizing posts being asymmetrical and corresponding to the asymmetrical pattern of polarizing holes, and the body member having a backup rib behind the circuit to support the exposed conductors of the circuit while in engagement with the conductors of the complementary connecting device.

2. The polarizing system of claim 1 wherein said backup rib is elevated and is elongated in a direction generally perpendicular to the insertion direction of the flat flexible circuit.

3. The polarizing system of claim 2 wherein said elevated backup rib is fabricated of yieldable material.

4. The polarizing system of claim 1 wherein said distal ends of the conductors of the flat flexible circuit are located between said polarizing holes and said backup rib.

5. A polarizing system in a connector for electrically interconnecting conductors of a flat flexible circuit to conductors of a complementary connecting device, comprising:

a flat flexible circuit having opposite flat sides and generally opposite edges all leading to a transversely leading edge of the circuit insertable into the connector in a circuit-insertion direction, with a longitudinal center-line generally parallel to said circuit-insertion direction and generally equidistant from the opposite edges of the circuit, a polarizing hole in the circuit spaced to one side of the center-line, the hole being spaced rearwardly from the leading edge of the circuit, the circuit being void of a hole at the same spacing on the opposite side of the center-line, and a plurality of generally parallel conductors on the circuit with distal ends of the conductors being spaced rearwardly from said pattern of polarizing holes; and a connector body member having a pair of side guide walls for positioning the flat flexible circuit therebetween in said circuit-insertion direction and exposing the conductors of the circuit for engagement with the conductors of the complementary connecting device, the body member defining a center-line between the side guide walls coincident with the longitudinal center-line of the flat flexible circuit, the body member having a polarizing post insertable into the polarizing hole of the circuit, the polarizing post being spaced to one side of center-line of the body member and the body member being void of a post at the same spacing on the opposite of the center-line, and the body member having a backup rib behind the circuit to support the exposed conductors of the circuit while in engagement with the conductors of the complementary connecting device.

6. The polarizing system of claim 5 wherein said backup rib is elevated and is elongated in a direction generally perpendicular to the insertion direction of the flat flexible circuit.

7. The polarizing system of claim 6 wherein said elevated backup rib is fabricated of yieldable material.

8. The polarizing system of claim 5 wherein said distal ends of the conductors of the flat flexible circuit are located between said polarizing holes and said backup rib.

* * * * *